United States Patent [19]

Knapp et al.

[11] 4,348,823

[45] Sep. 14, 1982

[54] SNOW LIFE SHOES

[76] Inventors: Frank H. Knapp, c/o George Spector, 3615 Woolworth Bldg., 233 Broadway; George Spector, 3615 Woolworth Bldg., 233 Broadway, both of New York, N.Y. 10007

[21] Appl. No.: 171,885

[22] Filed: Jul. 24, 1980

[51] Int. Cl.[3] ..... A43B 5/04

[52] U.S. Cl. ..... 36/123; 36/124

[58] Field of Search ..... 36/123, 124, 122, 125

[56] References Cited

U.S. PATENT DOCUMENTS 3,555,707 1/1971 Sharratt et al. ..... 36/123

3,636,643 1/1972 Lundquist ..... 36/123

4,213,256 7/1980 Mas et al. ..... 36/124

4,228,601 10/1980 Lawton et al. ..... 36/124

*Primary Examiner*—Patrick D. Lawson

[57] ABSTRACT

A pair of collapsibly foldable snowshoes for walking upon deep or shallow snow; each shoe including a tubular frame consisting of interfitted sections that snapfit rigidly together for use, a flexible endless cord passed through all the sections for holding them together in tension, a web inside the frame consisting of separate fillers at front, center and near sections, and cleats on an underside of the fillers for traction against slipping on a snow; the frame supporting shoe bungees.

2 Claims, 9 Drawing Figures

SNOW LIFE SHOES

This invention relates generally to snow shoes for being worn by a person walking upon snow so as to not sink excessively therein.

It is well known to those persons experienced with the use of conventional snowshoes that they can be cumbersome, due to their size when being transported such as in an airplane, automobile or on a back pack. In snow covered countries, pilots include them as necessary equipment, in case they become stranded in a wilderness and are obliged to try to walk out across deep snow. However conventional snowshoes do not store compactly inside the plane. Upon a back pack of a person moving through a brush, the projecting snowshoes can get hung up in branches. Accordingly this situation is in need of an improvement.

Therefore it is a principal object of the present invention to provide a snowshoe that is foldable, so that when not in use, it conveniently fits into a minimum storage space, but which can be readily and easily assembled together for use when needed. In the drawing.

Figures 1, 2, 3, 4, 5, 6, 7, 8, 9:
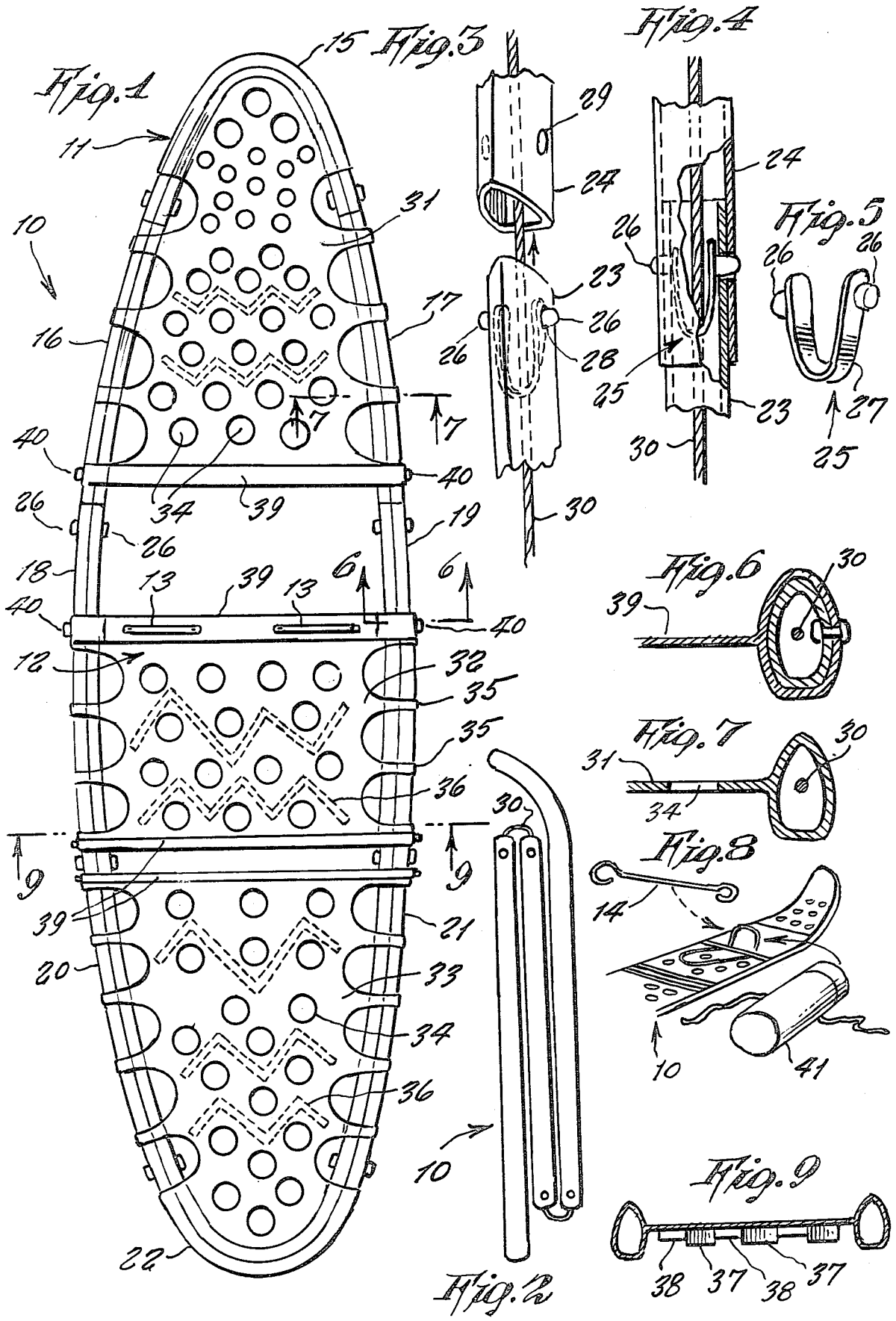
FIG. 1 is a top plan view of the snowshoe, shown in an assembled, utility position.
FIG. 2 is a side edge view thereof showing the snowshoe in a folded position.
FIG. 3 is an enlarged detail showing how frame sections thereof interfit together.
FIG. 4 is a view thereof shown snapfitted together.
FIG. 5 is a perspective view of a locking button member shown in FIGS. 3 and 4.
FIG. 6 is an enlarged cross sectional view on line 6—6 of FIG. 1.
FIG. 7 is an enlarged cross sectional view on line 7—7 of FIG. 1.
FIG. 8 is a perspective view of a forward portion of the snowshoe, shown with a bungee or shoe binding holder and also with an emergency packet removably attachable under the bungee.
FIG. 9 is a cross sectional view on line 9—9 of FIG. 1 showing details of an underside cleat.

Referring now to the drawing in greater detail, the reference numeral 10 represents a snow life shoe according to the present invention wherein there is a tubular frame 11 inside of which there is supported a web 12 for resting upon a surface of a snow, and the frame supporting bungees or shoe bindings 13 and 14 for a wearer's shoe.

The frame is comprised of a plurality of tubular sections that snapfit together and include a U-shaped front bow 15, a front left tube 16, a right front tube 17, a left center tube 18, a right center tube 19, a left rear tube 20, a right rear tube 21, and rear bow 22. As shown in FIGS. 3, 4 and 5, the tubes telescopically interfit together by means of one end 23 of each tube being narrower in order to slide inside an expanded end 24 of an adjacent tube. The narrow end contains a snap lock 25 consisting of a rounded button 26 on opposite ends of a U-shaped tension spring 27 which are snapped in holes 28 on opposite side walls of the inner tube. When the end 23 is pushed inside the end 24, the button then snap fit into holes 29 an opposite side walls of the outer tube, thus locking the tubes rigidly together in an assembled condition.

An endless elastic cord 30 extends through all the tubes, and serves to pull the tubes together under tension.

When the tubes or sections are pulled apart, they may then be folded alongside each other as shown in FIG. 2, so that the snowshoe thus takes up less space for easy storage.

The web 12 inside the frame comprises a front filler 31, a center filler 32 and a rear filler 33. These are made of plastic so to not deteriorate in subzero temperatures and unlike conventional snowshoe with webs of gat or leather, are thus rodent-proof. They may be made of color: orange for easy spotting from the air or ground by rescue searchers, white for camouflage by ground troops on snow; or any other color. They are perforated with holes 34 so to decrease weight. The fillers are secured by buttons 35 to the frame.

Cleats 36 on an underside of the filler provide traction against the snowshoe skidding on the snow. While such cleats may be made as straight transverse ribs, they may alternately be made V-shaped as shown so as to also prevent sideward slipping, such as when walking along an inclined embardment of a river or alongside a hill. Also each snowshoe may include each alternate leg 37 of each V of the cleat, and which extend angularly-rearwardly outward to be deeper in the snow than the legs 38 thereof in order to tend keeping the snowshoes from spreading too far sidewardly away from each other when walking.

The frame includes cross members 39 affixed thereto by pop rivets 40. The bungee 13 is affixed to one of these, while the bungee 14 hooked across the heels and toes is carried thereby.

An emergency container 41 is detachably held under the bungee 14 when the snowshoe is not used, the container being of metal, and containing an inflatable space blanket, a quantity of high protein tablets and fire starting material; the metal container serving as a vessel for holding melted snow for use as drinking water. When the snowshoe is in use, the container may be suspended from a wearer's belt.

What is claimed as new is:

1. A pair of snow life shoes, each one of which comprises in combination a snowshoe including a foldable frame around a web, and a pair of shoe binding holders supported upon cross members of said frame, and said web including cleats on an underside thereof said cleats including means to tend said snowshoes to spread apart from each other, wherein said frame includes a plurality of tubes telescopically snap fitted together wherein an endless elastic cord extends through all said tubes for pulling them together under tension.

2. The combination as set forth in claim 1 wherein an emergency container is removably held upon one said holders said container being of metal and containing an inflatable spare blanket, high protein tablets and fire making materials.

* * * * *